US010934509B2

(12) United States Patent
Boers et al.

(10) Patent No.: US 10,934,509 B2
(45) **Date of Patent: *Mar. 2, 2021**

(54) CLEANING PRODUCT

(71) Applicant: The Procter & Gamble Company, Cincinnati, OH (US)

(72) Inventors: Wesley Yvonne Pieter Boers, Antwerp (BE); Peter Vancampenhout, Berg (BE); Denis Alfred Gonzales, Brussels (BE); Aicha Dkidak, Brussels (BE); Jean-Luc Philippe Bettiol, Etterbeek (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/111,437

(22) Filed: Aug. 24, 2018

(65) Prior Publication Data

US 2018/0362900 A1 Dec. 20, 2018

Related U.S. Application Data

(63) Continuation of application No. 15/192,176, filed on Jun. 24, 2016, now Pat. No. 10,138,446.

(30) Foreign Application Priority Data

Jul. 13, 2015 (EP) ..... 15176541

(51) Int. Cl.

| | |
|---|---|
| ***C11D 1/29*** | (2006.01) |
| ***C11D 1/75*** | (2006.01) |
| ***C11D 1/88*** | (2006.01) |
| ***C11D 3/30*** | (2006.01) |
| ***B08B 3/04*** | (2006.01) |
| ***C11D 17/00*** | (2006.01) |
| ***C11D 1/83*** | (2006.01) |
| ***C11D 1/94*** | (2006.01) |
| ***C11D 3/20*** | (2006.01) |
| ***C11D 3/43*** | (2006.01) |
| ***C11D 17/04*** | (2006.01) |
| ***B08B 3/00*** | (2006.01) |
| ***B08B 3/08*** | (2006.01) |
| ***C11D 11/00*** | (2006.01) |

(52) U.S. Cl.

CPC ..... *C11D 17/0043* (2013.01); *B08B 3/003* (2013.01); *B08B 3/08* (2013.01); *C11D 1/29* (2013.01); *C11D 1/75* (2013.01); *C11D 1/83* (2013.01); *C11D 1/94* (2013.01); *C11D 3/2068* (2013.01); *C11D 3/43* (2013.01); *C11D 11/0023* (2013.01); *C11D 17/041* (2013.01)

(58) Field of Classification Search

CPC .... C11D 1/29; C11D 1/75; C11D 1/88; C11D 3/2003; C11D 3/2068; C11D 3/30; B08B 3/04

See application file for complete search history.

(56) References Cited

U.S. PATENT DOCUMENTS

| | | | | |
|---|---|---|---|---|
| 3,969,134 | A | 7/1976 | Batka et al. | |
| 5,478,500 | A | 12/1995 | Swift et al. | |
| 5,906,973 | A | 5/1999 | Ouzounis et al. | |
| 10,138,446 | B2 * | 11/2018 | Boers | C11D 1/29 |
| 2002/0069900 | A1 * | 6/2002 | Evers | C11D 1/94 134/40 |
| 2005/0003990 | A1 | 1/2005 | Smith et al. | |
| 2005/0282722 | A1 * | 12/2005 | McReynolds | B65D 81/3283 510/302 |
| 2006/0040843 | A1 | 2/2006 | Kinnaird et al. | |
| 2006/0100119 | A1 | 5/2006 | Smith | |
| 2006/0100128 | A1 | 5/2006 | McCue et al. | |
| 2007/0149437 | A1 | 6/2007 | Boggs et al. | |
| 2008/0255018 | A1 | 10/2008 | Riou et al. | |
| 2010/0240562 | A1 | 9/2010 | Herdt et al. | |
| 2011/0022293 | A1 | 1/2011 | Sharma et al. | |
| 2011/0105377 | A1 | 5/2011 | Yianakopoulos et al. | |
| 2011/0226293 | A1 * | 9/2011 | Bonnechere | C11D 3/044 134/198 |
| 2012/0102668 | A1 | 5/2012 | De Leersnyder et al. | |
| 2012/0264673 | A1 | 10/2012 | Keller et al. | |
| 2014/0199416 | A1 | 7/2014 | Gaudreault | |
| 2014/0290694 | A1 * | 10/2014 | Uchiyama | C11D 1/12 134/6 |
| 2017/0015940 | A1 | 1/2017 | Boers et al. | |

(Continued)

FOREIGN PATENT DOCUMENTS

| | | | |
|---|---|---|---|
| DE | 19504192 | A1 | 8/1996 |
| DE | 10162648 | A1 | 7/2003 |

(Continued)

OTHER PUBLICATIONS

DOWANOL PnB Technical Data Sheet, http://msdssearch.dow.com/PublishedLiteratureDOWCOM/dh_08ad/0901b803808ad67a.pdf?filepath=oxysolvents/pdfs/noreg/110-00616.pdf&fromPage=GetDoc retrieved Jan. 1, 2016, 3 pages.

European Search Report for EP Application No. 15176541.9-1358, dated Jan. 8, 2016, 8 pages.

Final Office Action for U.S. Appl. No. 15/192,038, dated Apr. 9, 2018, 7 pages.

Final Office Action for U.S. Appl. No. 15/192,124, dated Apr. 25, 2018, 7 pages.

Final Office Action for U.S. Appl. No. 15/202,748, dated May 15, 2018, 14 pages.

(Continued)

*Primary Examiner* — Brian P Mruk

(74) *Attorney, Agent, or Firm* — Melissa Krasovec

(57) ABSTRACT

A cleaning product having a spray dispenser and a cleaning composition suitable for spraying and foaming, the composition housed in the spray dispenser wherein the composition contains: i) 2 to 15% by weight of a surfactant system comprising an alkyl ethoxylated sulfate anionic surfactant and a specific co-surfactant; and ii) a specific glycol ether solvent.

14 Claims, No Drawings

(56) References Cited

U.S. PATENT DOCUMENTS

| | | | |
|---|---|---|---|
| 2017/0015941 | A1 | 1/2017 | Boers et al. |
| 2017/0015946 | A1 | 1/2017 | Dkidak et al. |
| 2017/0015953 | A1 | 1/2017 | Boers et al. |
| 2017/0015960 | A1 | 1/2017 | Boers et al. |
| 2017/0015961 | A1 | 1/2017 | Boers et al. |
| 2017/0015962 | A1 | 1/2017 | Boers et al. |

FOREIGN PATENT DOCUMENTS

| | | | |
|---|---|---|---|
| DE | 102004063765 | A1 | 7/2006 |
| EP | 0384715 | A2 | 8/1990 |
| EP | 0805197 | A1 | 11/1997 |
| EP | 0839907 | A1 | 5/1998 |
| EP | 1493803 | A1 | 6/2006 |
| EP | 2025743 | A1 | 2/2009 |
| EP | 2431455 | A1 | 3/2012 |
| GB | 2279362 | A | 1/1995 |
| WO | WO9115565 | A1 | 10/1991 |
| WO | WO9424654 | A1 | 10/1994 |
| WO | WO9626263 | A1 | 8/1996 |
| WO | WO9715649 | A1 | 5/1997 |
| WO | WO9732968 | A1 | 9/1997 |
| WO | WO9918183 | A1 | 4/1999 |
| WO | WO9919441 | A1 | 4/1999 |
| WO | WO9935227 | A1 | 7/1999 |
| WO | WO9943778 | A1 | 9/1999 |
| WO | WO0104251 | A1 | 1/2001 |
| WO | WO0121719 | A1 | 3/2001 |
| WO | WO0206437 | A1 | 1/2002 |
| WO | WO2009074766 | A1 | 6/2009 |
| WO | WO2011051161 | A1 | 5/2011 |

OTHER PUBLICATIONS

Herr, Norman Ph.D., Bubble Life Span & Temperature (Chelsey Traylor), Nov. 15, 2013, 1 page.

International Search Report for International Application Serial No. PCT/US2016/040277, dated Sep. 14, 2016, 13 pages.

Lunkenheimer, Klaus, et al., Dowanol DPnB in Water as an Example of a Solvo-Surfactant System: Adsorption and Foam Properties, Progress in Colloid and Polymer Science; vol. 126, Jan. 1, 2004, pp. 14-20.

Non-Final Office Action for U.S. Appl. No. 15/192,038, dated Oct. 19, 2017, 21 pages.

Non-Final Office Action for U.S. Appl. No. 15/192,057, dated Nov. 21, 2017, 15 pages.

Non-Final Office Action for U.S. Appl. No. 15/192,124, dated Oct. 19, 2017, 17 pages.

Non-Final Office Action for U.S. Appl. No. 15/192,164, dated Nov. 20, 2017, 15 pages.

Non-Final Office Action for U.S. Appl. No. 15/192,176, dated Nov. 21, 2017, 16 pages.

Non-Final Office Action for U.S. Appl. No. 15/202,748, dated May 30, 2017, 21 pages.

Notice of Allowance and Fees Due for U.S. Appl. No. 15/192,057, dated May 18, 2018, 7 pages.

Notice of Allowance and Fees Due for U.S. Appl. No. 15/192,164, dated May 10, 2018, 7 pages.

Notice of Allowance and Fees Due for U.S. Appl. No. 15/192,176, dated May 16, 2018, 7 pages.

PCC Natural Markets, Choosing the right cooking oil, Nov. 30, 2012.

* cited by examiner

CLEANING PRODUCT

The instant application is a continuation of application Ser. No. 15/192,176, filed on Jun. 24, 2016, now U.S. Pat. No. 10,138,446.

FIELD OF INVENTION

The present invention relates to a cleaning product. In particular, it relates to a cleaning product comprising a spray dispenser and a cleaning composition. The product makes the cleaning of dishware easier and faster.

BACKGROUND OF THE INVENTION

Traditionally manual dishwashing has been performed by filling a sink with water, adding a dishwashing detergent to create a soapy solution, immersing the soiled articles in the solution, scrubbing the articles and rinsing to remove the remaining soils and remove the suds generated from the soapy solution from the washed articles. Traditionally an entire load of soiled dishware has usually been washed in one go. Nowadays some users prefer to clean articles as soon as they have finished with them rather than wait until they have a full load. This involves washing one article or a small number of articles at the time. The washing is usually performed under running water rather than in a full sink. The cleaning should be fast and involve minimum effort from the user.

Nowadays, a high number of users prefer to do the washing under the tap. This usually involves the use of a cleaning implement, such as a sponge. The user delivers detergent to the sponge. When the number of items to be cleaned is small, there is the risk of dosing more detergent than required, this will require the need for more rinsing for the dishware and the cleaning implement. Another disadvantage associated to this method, is that some time is required to mix the detergent with water in the sponge, this can slow down the cleaning process.

The level and type of soil found on dishware varies considerably depending on the use of the dishware. Dishware can be lightly soiled or can have hard to remove soils such as baked-, cooked- and/or burnt-on soils. It might be easier to design different products for different types/degrees of soils however this might not be very practical because the user would have to have a large number of dishwashing products.

When the cleaning of a lightly soiled article is done under running water, it is desirable that the cleaning is performed quickly and with minimum effort. Ideally, the product should be applied and then immediately rinsed obviating or reducing the need for scrubbing.

When articles are soiled with difficult to remove soils, it is desirable that the product facilitates the cleaning task by softening the well-attached soils. It is desirable that the softening takes place in a short time. In cases in which the soils are really tough it is common practice to soak the items before cleaning. The soaking time should be short.

Spray products are well liked by users. A sprayable composition for use in hand dishwashing should be easy to spray, deliver fast and long lasting suds, easy to rinse and at the same time should provide fast and good cleaning of a variety of soils. The composition should be such that when sprayed onto the dishware spreading to the surrounding atmosphere should be minimised or avoided. Spreading to the surrounding atmosphere can not only give rise to waste of the product but it can also have inhalation risks associated to it.

The object of the present invention is to facilitate cleaning, especially the manual dishwashing task, in particular by reducing the time and effort needed to achieve the cleaning.

SUMMARY OF THE INVENTION

According to a first aspect of the invention, there is provided a cleaning product. The product is suitable for the cleaning of any kind of surfaces but preferably the product is a hand dishwashing cleaning product. The product comprises a spray dispenser and a cleaning composition. The composition is a foaming composition and it is suitable for spraying. The composition is housed in the spray dispenser. The "composition" of the cleaning product of the invention is herein sometimes referred to as "the composition of the invention".

By "spray dispenser" is herein meant a container comprising a housing to accommodate the composition and means to spray that composition. The preferred spraying means being a trigger spray. The composition foams when it is sprayed. Foaming is a property that users associate with cleaning therefore it is important that the composition of the invention foams to send the user the signal that the composition is cleaning.

The composition of the invention comprises:

i) 2 to 15% by weight of a surfactant system comprising an alkyl ethoxylated sulfate anionic surfactant and a co-surfactant selected from the group consisting of amphoteric surfactant, zwitteronic surfactant and mixtures thereof; and ii) a glycol ether solvent selected from the group consisting of glycol ethers of Formula I: R1O(R2O)nR3, Formula II: R4O(R5O)nR6 and mixtures thereof wherein R1 is a linear or branched C4, C5 or C6 alkyl or a substituted or unsubstituted phenyl, R2 is ethyl or isopropyl, R3 is hydrogen or methyl and n is 1, 2 or 3

R4 is n-propyl or isopropyl, R5 is isopropyl, R6 is hydrogen or methyl and n is 1, 2 or 3

The surfactant system and the glycol ether solvent are preferably in a weight ratio of from about 5:1 to about 1:1, preferably from about 3:1 to about 1:1. The surfactant system seems to help with the cleaning and foam generation. The suds generated when spraying the composition of the invention are strong enough to withstand the impact force when the foam contact the article to be washed but at the same time the composition is easy to rinse.

Furthermore, the composition of the invention provides good cleaning, including cleaning of though food soils such as cooked-, baked- and burnt-on soils and good cleaning of light oily soils. The composition of the invention not only provides outstanding cleaning but also very fast cleaning, requiring reduced scrubbing effort by the consumer. Thus the product of the invention is especially suitable for cleaning dishware under the tap. When the dishware is only lightly soiled the composition of the invention provides very good cleaning with reduced scrubbing or in the absence of scrubbing. The dishware can be cleaned by simply spraying the composition followed by a rinse with water, optionally aided by a low force wiping action.

In the case of heavily soiled dishware the product of the invention is very good to facilitate the removal of the soil when the product is used to pre-treat the dishware. Pre-treatment usually involves leaving the soiled dishware with the neat product.

Compositions having the claimed level of surfactant system and the claimed weight ratio of surfactant system to glycol ether solvent when sprayed provide good coverage on the dishware with minimum over spray, thereby avoiding wasting product or the risk of inhalation.

Compositions having a surfactant:solvent weight ratio lower than 1:1 do not seem to be able to foam and/or tend to phase separate creating physical instability in the product. Compositions having a surfactant:solvent weight ratio higher than 5:1 are difficult to spray and are prone to gelling when in contact with greasy soils in the presence of the low levels of water typically present when the product of the invention is used. Gel formation would inhibit the spreading of the composition negatively impairing on the cleaning.

Preferably, the composition of the invention has a pH greater than 8, more preferably from 10 to 12, most preferably from 10.5 to 11.5 as measured at 10% solution in distilled water at 20° C. and a reserve alkalinity of from about 0.1 to about 1, more preferably from about 0.1 to about 0.5. Reserve alkalinity is herein expressed as grams of NaOH/100 ml of composition required to titrate product from a pH 10 to the pH of the finished composition. This pH and reserve alkalinity further contribute to the cleaning of tough food soils.

Compositions having a surfactant system comprising an alkyl ethoxylated sulfate anionic surfactant and a co-surfactant have been found to be very good from a cleaning and sudsing viewpoint. They have also been found very good from a spray pattern view point. The presence of small droplets (and therefore the risk of inhalation) is minimized when the surfactant system of the composition of the invention contains anionic surfactant. By co-surfactant is herein meant a surfactant that is present in the composition in an amount lower than the main surfactant. By main surfactant is herein meant the surfactant that is present in the composition in the highest amount. It has been found that alkyl ethoxylated sulfate with an average degree of ethoxylation from about 2 to about 4, more preferably about 3, performs better in terms of cleaning and speed of cleaning than other ethoxylated alkyl sulfate surfactants with a lower degree of ethoxylation.

Preferably, the co-surfactant is selected from the group consisting of betaine, amine oxide and mixtures thereof. Amine oxide is the preferred co-surfactant for use herein. The co-surfactant seems to help with the sudsing of the product. Particularly good performing products are those in which the anionic alkyl ethoxylated sulfate surfactant and the co-surfactant are present in a weight ratio of about 4:1 to about 1:1, preferably in a weight ratio of from about 3:1 to about 2:1, most preferably in a weight ratio from about 2.8:1 to about 1.3:1. Especially preferred are compositions in which the co-surfactant comprises amine oxide.

The composition of the invention comprises glycol ethers selected from the group consisting glycol ethers of Formula I, Formula II and mixtures thereof. It has been found that these glycol ethers help not only with the speed of cleaning of the product but also with the cleaning, especially greasy soils cleaning. This does not seem to happen with glycol ethers having a different formula to Formula I and Formula II.

Preferably, the composition of the invention further comprises a chelant, preferably an aminocarboxylate chelant, more preferably GLDA. The aminocarboxylate not only act as a chelant but also contributes to the reserve alkalinity, this seems to help with the cleaning of cooked-, baked- and burnt-on soils. Preferably, the composition of the invention comprises bicarbonate and/or monoethanol and/or carboxylate builder preferably citrate builder, that as in the case of the of the aminocarboxylate chelant also contribute to the reserve alkalinity.

The composition of the invention can be Newtonian or non-Newtonian. Preferably the composition is a shear thinning fluid. This is important to allow the composition to be easily sprayed. The viscosity of the composition of the invention should also make the fluid to stay in vertical surfaces to provide cleaning and at the same time be easy to rinse. Especially suitable have been found compositions having a starting viscosity at high shear (10,000 s-1) of from about 1 to about 10 mPa s. Preferably, the composition is a shear thinning composition having a low shear (100 s-1) to high shear (10,000 s-1) viscosity ratio of from about 10:1 to about 1.5:1 at 20° C. as measured using the method defined herein below. Preferably the compositions of the invention comprises xanthan gum.

A preferred composition has a pH of from 10 to 11.5 as measured in a 10% solution in distilled water at 20° C., a reserve alkalinity of from 0.1 to 0.3 expressed as g NAOH/100 ml of composition at a pH of 10, the composition comprising:

i) from about 4 to about 10%, preferably from about 5 to about 8% by weight of the composition of an alkyl ethoxylated sulfate, preferably the alkyl ethoxylated sulfate having an average degree of ethoxylation of about 3;
ii) from about 1 to about 5% by weight of the composition of amine oxide surfactant; and
iii) from about 3% to about 8%, preferably from about 4 to about 7% by weight of the composition of glycol ether solvent, preferably dipropylene glycol n-butyl ether.

According to the second aspect of the invention, there is provided a method of cleaning soiled dishware using the product according to any of the preceding claims comprising the steps of:

a) optionally pre-wetting the soiled dishware
b) spraying the cleaning composition onto the soiled dishware;
c) optionally adding water to the soiled dishware during a period of time;
d) optionally scrubbing the dishware; and
e) rinsing the dishware.

The method of the invention allows for faster and easier cleaning of dishware under running tap, especially when the dishware is lightly soiled. When the dishware is soiled with tough food soils such as cooked-, baked- or burnt-on soils the method of the invention facilitates the cleaning when the soiled dishware is soaked with the product of the invention in neat form or diluted in water.

DETAILED DESCRIPTION OF THE INVENTION

The present invention envisages a cleaning product, preferably a hand dishwashing cleaning product, the product comprises a spray dispenser and a cleaning composition. The cleaning composition comprises a surfactant system and a specific glycol ether solvent. The product of the invention simplifies the cleaning task, in particular the manual cleaning task, by making the task easier and faster. The product of the invention is particularly suitable for the manual cleaning of dishware.

For the purpose of the present invention "dishware" encompasses all the items used to either cook or used to serve and eat food.

Cleaning Composition

The cleaning composition is preferably a hand dishwashing cleaning composition, preferably in liquid form.

Preferably the pH of the composition is greater than 8, more preferably from about 10 to about 12 and most preferably from about 10.5 to about 11.5, as measured at 20° C. and 10% concentration in distilled water. Preferably, the composition has a reserve alkalinity of from about 0.1 to about 1, more preferably from about 0.1 to about 0.5 measured as detailed herein below.

Reserve alkalinity is defined as the grams of NaOH per 100 g of composition required to titrate the test composition at pH 10 to come to the test composition pH. The reserve alkalinity for a solution is determined in the following manner.

A pH meter (for example An Orion Model 720A) with a Ag/AgCl electrode (for example an Orion sure flow Electrode model 9172BN) is calibrated using standardized pH 7 and pH 10 buffers. A 100 g of a 10% solution in distilled water at 20° C. of the composition to be tested is prepared. The pH of the 10% solution is measured and the 100 g solution is titrated down to pH 10 using a standardized solution of 0.1 N of HCl. The volume of 0.1N HCl required is recorded in ml. The reserve alkalinity is calculated as follows:

Reserve Alkalinity=ml 0.1N HCl×0.1(equivalent/liter)×Equivalent weight NaOH (g/equivalent)×10

Surfactant System

The cleaning composition comprises from about 2% to about 15%, preferably from about 5% to about 14%, more preferably from about 6% to about 12% by weight thereof of a surfactant system. The surfactant system comprises an alkyl ethoxylated sulfate anionic surfactant. The system comprises a co-surfactant preferably selected from the group consisting of amphoteric surfactants, zwitterionic surfactants and mixtures thereof. The system can optionally comprise a non-ionic surfactant.

Alkyl ethoxy sulfates with an average degree of ethoxylation from about 2 to about 5, most preferably about 3 are preferred for use herein.

Preferably, the anionic alkyl ethoxylated sulfate surfactant and the co-surfactant are present in the composition of the invention in a weight ratio of about 4:1 to about 1:1, preferably from 3:1 to 1:1 and more preferably from 2.8:1 to 1.3:1.

The most preferred surfactant system for the detergent composition of the present invention comprise: (1) 4% to 10%, preferably 5% to 8% by weight of the composition of an alkyl ethoxylated sulfate anionic surfactant; (2) 1% to 5%, preferably from 1% to 4% by weight of the composition of a surfactant selected from the group consisting of amphoteric surfactant, zwitterionic surfactant and mixtures thereof, preferably an amine oxide surfactant. It has been found that such surfactant system in combination with the glycol ether of the invention provides excellent cleaning and good foaming profile.

Alkyl Ethoxylated Sulfate Anionic Surfactant

A preferred sulfate anionic surfactant is an alkoxylate, more preferably, an alkoxylate sulfate anionic surfactant having an average alkoxylation degree from about 2 to about 5, most preferably about 3. Preferably, the alkoxy group is ethoxy. When the sulfate anionic surfactant is a mixture of sulfate anionic surfactants, the average alkoxylation degree is the weight average alkoxylation degree of all the components of the mixture (weight average alkoxylation degree). In the weight average alkoxylation degree calculation the weight of sulfate anionic surfactant components not having alkoxylate groups should also be included.

Weight average alkoxylation degree=($x1$*alkoxylation degree of surfactant 1+$x2$*alkoxylation degree of surfactant 2+ . . . )/($x1$+$x2$+ . . . )

wherein x1, x2, . . . are the weights in grams of each sulfate anionic surfactant of the mixture and alkoxylation degree is the number of alkoxy groups in each sulfate anionic surfactant.

If the surfactant is branched, the preferred branching group is an alkyl. Typically, the alkyl is selected from methyl, ethyl, propyl, butyl, pentyl, cyclic alkyl groups and mixtures thereof. Single or multiple alkyl branches could be present on the main hydrocarbyl chain of the starting alcohol(s) used to produce the sulfate anionic surfactant used in the detergent of the invention.

The branched sulfate anionic surfactant can be a single anionic surfactant or a mixture of anionic surfactants. In the case of a single surfactant the percentage of branching refers to the weight percentage of the hydrocarbyl chains that are branched in the original alcohol from which the surfactant is derived.

In the case of a surfactant mixture the percentage of branching is the weight average and it is defined according to the following formula:

Weight average of branching (%)=[($x1$*wt % branched alcohol 1 in alcohol 1+$x2$*wt % branched alcohol 2 in alcohol 2+ . . . )/($x1$+$x2$+ . . . )]*100 wherein x1, x2, are the weight in grams of each alcohol in the total alcohol mixture of the alcohols which were used as starting material for the anionic surfactant for the detergent of the invention. In the weight average branching degree calculation the weight of anionic surfactant components not having branched groups should also be included.

When the surfactant system comprises a branched anionic surfactant, the surfactant system comprises at least 50%, more preferably at least 60% and preferably at least 70% of branched anionic surfactant by weight of the surfactant system, more preferably the branched anionic surfactant comprises more than 50% by weight thereof of an alkyl ethoxylated sulfate having an average ethoxylation degree of from about 2 to about 5 and preferably a level of branching of from about 5% to about 40%.

Suitable sulfate surfactants for use herein include water-soluble salts of C8-C18 alkyl, preferably C8-C18 alkyl comprising more than 50% by weight of the C8 to C18 alkyl of C12 to C14 alkyl or hydroxyalkyl, sulfate and/or ether sulfate. Suitable counterions include alkali metal cation earth alkali metal cation, alkanolammonium or ammonium or substituted ammonium, but preferably sodium.

The sulfate surfactants may be selected from C8-C18 alkyl alkoxy sulfates (AExS) wherein preferably x is from 1-30 in which the alkoxy group could be selected from ethoxy, propoxy, butoxy or even higher alkoxy groups and mixtures thereof. Especially preferred for use herein is a C12-C14 alkyl ethoxy sulfate with an average degree of ethoxylation from about 2 to about 5, preferably about 3.

Alkyl alkoxy sulfates are commercially available with a variety of chain lengths, ethoxylation and branching degrees. Commercially available sulfates include, those based on Neodol alcohols ex the Shell company, Lial—Isalchem and Safol ex the Sasol company, natural alcohols ex The Procter & Gamble Chemicals company.

If the anionic surfactant is branched, it is preferred that the branched anionic surfactant comprises at least 50%, more preferably at least 60% and especially at least 70% of a sulfate surfactant by weight of the branched anionic surfactant. Preferred from a cleaning view point are those branched surfactants in which the branched anionic surfactant comprises more than 50%, more preferably at least 60% and especially at least 70% by weight thereof of sulfate surfactant and the sulfate surfactant is selected from the group consisting of alkyl sulfate, alkyl ethoxy sulfates and mixtures thereof. Even more preferred are those in which the branched anionic surfactant has an average degree of ethoxylation of from about 2 to about 5, more preferably about 3 and even more preferably when the anionic surfactant has an average level of branching of from about 10% to about 35%, more preferably from about 20% to 30%.

Linear alkyl alkoxylate sulfate surfactants are preferred for use in the composition of the invention.

The branched short chain alkyl sulphate surfactant will be formulated from about 3% to about 10%, preferably from about 4% to about 8% by weight of the composition.

The branched short chain alkyl sulphate surfactant will be formulated from about 50% to about 100%, preferably from about 55% to about 75% by weight of the total surfactant composition.

Amphoteric Surfactant

Preferably the amphoteric surfactant is an amine oxide. Preferred amine oxides are alkyl dimethyl amine oxide or alkyl amido propyl dimethyl amine oxide, more preferably alkyl dimethyl amine oxide and especially coco dimethyl amino oxide. Amine oxide may have a linear or mid-branched alkyl moiety. Typical linear amine oxides include water-soluble amine oxides containing one R1 C8-18 alkyl moiety and 2 R2 and R3 moieties selected from the group consisting of C1-3 alkyl groups and C1-3 hydroxyalkyl groups. Preferably amine oxide is characterized by the formula R1–N(R2)(R3)O wherein R1 is a C8-18 alkyl and R2 and R3 are selected from the group consisting of methyl, ethyl, propyl, isopropyl, 2-hydroxethyl, 2-hydroxypropyl and 3-hydroxypropyl. The linear amine oxide surfactants in particular may include linear C10-C18 alkyl dimethyl amine oxides and linear C8-C12 alkoxy ethyl dihydroxy ethyl amine oxides. Preferred amine oxides include linear C10, linear C10-C12, and linear C12-C14 alkyl dimethyl amine oxides. As used herein "mid-branched" means that the amine oxide has one alkyl moiety having n1 carbon atoms with one alkyl branch on the alkyl moiety having n2 carbon atoms. The alkyl branch is located on the a carbon from the nitrogen on the alkyl moiety. This type of branching for the amine oxide is also known in the art as an internal amine oxide. The total sum of n1 and n2 is from 10 to 24 carbon atoms, preferably from 12 to 20, and more preferably from 10 to 16. The number of carbon atoms for the one alkyl moiety (n1) should be approximately the same number of carbon atoms as the one alkyl branch (n2) such that the one alkyl moiety and the one alkyl branch are symmetric. As used herein "symmetric" means that $|n1-n2|$ is less than or equal to 5, preferably 4, most preferably from 0 to 4 carbon atoms in at least 50 wt %, more preferably at least 75 wt % to 100 wt % of the mid-branched amine oxides for use herein.

The amine oxide further comprises two moieties, independently selected from a C1-3 alkyl, a C1-3 hydroxyalkyl group, or a polyethylene oxide group containing an average of from about 1 to about 3 ethylene oxide groups. Preferably the two moieties are selected from a C1-3 alkyl, more preferably both are selected as a C1 alkyl.

Zwitterionic Surfactant

Other suitable surfactants include zwitterionic surfactants, preferably betaines, such as alkyl betaines, alkylamidobetaine, amidazoliniumbetaine, sulfobetaine (INCI Sultaines) as well as the Phosphobetaine and preferably meets formula (I):

$$R1\text{-}[CO\text{—}X(CH2)n]x\text{-}N+(R2)(R3)\text{-}(CH2)m\text{-}[CH(OH)\text{—}CH2]y\text{-}Y\text{—} \quad (I)$$

wherein

R1 is a saturated or unsaturated C6-22 alkyl residue, preferably C8-18 alkyl residue, in particular a saturated C10-16 alkyl residue, for example a saturated C12-14 alkyl residue;

X is NH, NR4 with C1-4 Alkyl residue R4, O or S, n a number from 1 to 10, preferably 2 to 5, in particular 3, x 0 or 1, preferably 1, R2, R3 are independently a C1-4 alkyl residue, potentially hydroxy substituted such as a hydroxyethyl, preferably a methyl.

m a number from 1 to 4, in particular 1, 2 or 3, y 0 or 1 and

Y is COO, SO3, OPO(OR5)O or P(O)(OR5)O, whereby R5 is a hydrogen atom H or a C1-4 alkyl residue.

Preferred betaines are the alkyl betaines of the formula (Ia), the alkyl amido propyl betaine of the formula (Ib), the Sulfo betaines of the formula (Ic) and the Amido sulfobetaine of the formula (Id);

$$R1\text{-}N+(CH3)2\text{-}CH2COO\text{—} \quad (Ia)$$

$$R1\text{-}CO\text{—}NH(CH2)3\text{-}N+(CH3)2\text{-}CH2COO\text{—} \quad (Ib)$$

$$R1\text{-}N+(CH3)2\text{-}CH2CH(OH)CH2SO3\text{-} \quad (Ic)$$

R1-CO—NH—(CH2)3-N+(CH3)2-CH2CH(OH) CH2SO3- (Id) in which R11 as the same meaning as in formula I. Particularly preferred betaines are the Carbobetaine [wherein Y—═COO—], in particular the Carbobetaine of the formula (Ia) and (Ib), more preferred are the Alkylamidobetaine of the formula (Ib).

Examples of suitable betaines and sulfobetaine are the following [designated in accordance with INCI]: Almondamidopropyl of betaines, Apricotam idopropyl betaines, Avocadamidopropyl of betaines, Babassuamidopropyl of betaines, Behenam idopropyl betaines, Behenyl of betaines, betaines, Canolam idopropyl betaines, Capryl/Capram idopropyl betaines, Carnitine, Cetyl of betaines, Cocamidoethyl of betaines, Cocam idopropyl betaines, Cocam idopropyl Hydroxysultaine, Coco betaines, Coco Hydroxysultaine, Coco/Oleam idopropyl betaines, Coco Sultaine, Decyl of betaines, Dihydroxyethyl Oleyl Glycinate, Dihydroxyethyl Soy Glycinate, Dihydroxyethyl Stearyl Glycinate, Dihydroxyethyl Tallow Glycinate, Dimethicone Propyl of PG-betaines, Erucam idopropyl Hydroxysultaine, Hydrogenated Tallow of betaines, Isostearam idopropyl betaines, Lauram idopropyl betaines, Lauryl of betaines, Lauryl Hydroxysultaine, Lauryl Sultaine, Milkam idopropyl betaines, Minkamidopropyl of betaines, Myristam idopropyl betaines, Myristyl of betaines, Oleam idopropyl betaines, Oleam idopropyl Hydroxysultaine, Oleyl of betaines, Olivamidopropyl of betaines, Palmam idopropyl betaines, Palm itam idopropyl betaines, Palmitoyl Carnitine, Palm Kernelam idopropyl betaines, Polytetrafluoroethylene Acetoxypropyl of betaines, Ricinoleam idopropyl betaines, Sesam idopropyl betaines, Soyam idopropyl betaines, Stearam idopropyl betaines, Stearyl of betaines, Tallowam idopropyl betaines, Tallowam idopropyl Hydroxysultaine, Tallow of betaines, Tallow Dihydroxyethyl of betaines, Undecylenam idopropyl betaines and Wheat Germam idopropyl betaines.

A preferred betaine is, for example, Cocoamidopropylbetaine.

Non Ionic Surfactant

Nonionic surfactant, when present, is comprised in a typical amount of from 0.1% to 10%, preferably 0.2% to 8%, most preferably 0.5% to 6% by weight of the composition. Suitable nonionic surfactants include the condensation products of aliphatic alcohols with from 1 to 25 moles of ethylene oxide. The alkyl chain of the aliphatic alcohol can either be straight or branched, primary or secondary, and generally contains from 8 to 22 carbon atoms. Particularly preferred are the condensation products of alcohols having an alkyl group containing from 10 to 18 carbon atoms, preferably from 10 to 15 carbon atoms with from 2 to 18 moles, preferably 2 to 15, more preferably 5-12 of ethylene oxide per mole of alcohol. Highly preferred nonionic surfactants are the condensation products of guerbet alcohols with from 2 to 18 moles, preferably 2 to 15, more preferably 5-12 of ethylene oxide per mole of alcohol.

Other suitable non-ionic surfactants for use herein include fatty alcohol polyglycol ethers, alkylpolyglucosides and fatty acid glucamides.

Glycol Ether Solvent

The composition of the invention comprises a glycol ether solvent selected from glycol ethers of Formula I or Formula II.

Formula I=R1O(R2O)$n$R3 wherein

R1 is a linear or branched C4, C5 or C6 alkyl, a substituted or unsubstituted phenyl, preferably n-butyl. Benzyl is one of the substituted phenyls for use herein.

R2 is ethyl or isopropyl, preferably isopropyl

R3 is hydrogen or methyl, preferably hydrogen n is 1, 2 or 3, preferably 1 or 2

Formula II=R4O(R5O)$n$R6 wherein

R4 is n-propyl or isopropyl, preferably n-propyl

R5 is isopropyl

R6 is hydrogen or methyl, preferably hydrogen n is 1, 2 or 3 preferably 1 or 2

Suitable glycol ether solvents according to Formula I include ethyleneglycol n-butyl ether, diethyleneglycol n-butyl ether, triethyleneglycol n-butyl ether, propyleneglycol n-butyl ether, dipropyleneglycol n-butyl ether, tripropyleneglycol n-butyl ether, ethyleneglycol n-pentyl ether, diethyleneglycol n-pentyl ether, triethyleneglycol n-pentyl ether, propyleneglycol n-pentyl ether, dipropyleneglycol n-pentyl ether, tripropyleneglycol n-pentyl ether, ethyleneglycol n-hexyl ether, diethyleneglycol n-hexyl ether, triethyleneglycol n-hexyl ether, propyleneglycol n-hexyl ether, dipropyleneglycol n-hexyl ether, tripropyleneglycol n-hexyl ether, ethyleneglycol phenyl ether, diethyleneglycol phenyl ether, triethyleneglycol phenyl ether, propyleneglycol phenyl ether, dipropyleneglycol phenyl ether, tripropyleneglycol phenyl ether, ethyleneglycol benzyl ether, diethyleneglycol benzyl ether, triethyleneglycol benzyl ether, propyleneglycol benzyl ether, dipropyleneglycol benzyl ether, tripropyleneglycol benzyl ether, ethyleneglycol isobutyl ether, diethyleneglycol isobutyl ether, triethyleneglycol isobutyl ether, propyleneglycol isobutyl ether, dipropyleneglycol isobutyl ether, tripropyleneglycol isobutyl ether, ethyleneglycol isopentyl ether, diethyleneglycol isopentyl ether, triethyleneglycol isopentyl ether, propyleneglycol isopentyl ether, dipropyleneglycol isopentyl ether, tripropyleneglycol isopentyl ether, ethyleneglycol isohexyl ether, diethyleneglycol isohexyl ether, triethyleneglycol isohexyl ether, propyleneglycol isohexyl ether, dipropyleneglycol isohexyl ether, tripropyleneglycol isohexyl ether, ethyleneglycol n-butyl methyl ether, diethyleneglycol n-butyl methyl ether triethyleneglycol n-butyl methyl ether, propyleneglycol n-butyl methyl ether, dipropyleneglycol n-butyl methyl ether, tripropyleneglycol n-butyl methyl ether, ethyleneglycol n-pentyl methyl ether, diethyleneglycol n-pentyl methyl ether, triethyleneglycol n-pentyl methyl ether, propyleneglycol n-pentyl methyl ether, dipropyleneglycol n-pentyl methyl ether, tripropyleneglycol n-pentyl methyl ether, ethyleneglycol n-hexyl methyl ether, diethyleneglycol n-hexyl methyl ether, triethyleneglycol n-hexyl methyl ether, propyleneglycol n-hexyl methyl ether, dipropyleneglycol n-hexyl methyl ether, tripropyleneglycol n-hexyl methyl ether, ethyleneglycol phenyl methyl ether, diethyleneglycol phenyl methyl ether, triethyleneglycol phenyl methyl ether, propyleneglycol phenyl methyl ether, dipropyleneglycol phenyl methyl ether, tripropyleneglycol phenyl methyl ether, ethyleneglycol benzyl methyl ether, diethyleneglycol benzyl methyl ether, triethyleneglycol benzyl methyl ether, propyleneglycol benzyl methyl ether, dipropyleneglycol benzyl methyl ether, tripropyleneglycol benzyl methyl ether, ethyleneglycol isobutyl methyl ether, diethyleneglycol isobutyl methyl ether, triethyleneglycol isobutyl methyl ether, propyleneglycol isobutyl methyl ether, dipropyleneglycol isobutyl methyl ether, tripropyleneglycol isobutyl methyl ether, ethyleneglycol isopentyl methyl ether, diethyleneglycol isopentyl methyl ether, triethyleneglycol isopentyl methyl ether, propyleneglycol isopentyl methyl ether, dipropyleneglycol isopentyl methyl ether, tripropyleneglycol isopentyl methyl ether, ethyleneglycol isohexyl methyl ether, diethyleneglycol isohexyl methyl ether, triethyleneglycol isohexyl methyl ether, propyleneglycol isohexyl methyl ether, dipropyleneglycol isohexyl methyl ether, tripropyleneglycol isohexyl methyl ether, and mixtures thereof.

Preferred glycol ether solvents according to Formula I are ethyleneglycol n-butyl ether, diethyleneglycol n-butyl ether, triethyleneglycol n-butyl ether, propyleneglycol n-butyl ether, dipropyleneglycol n-butyl ether, tripropyleneglycol n-butyl ether, and mixtures thereof.

Most preferred glycol ethers according to Formula I are propyleneglycol n-butyl ether, dipropyleneglycol n-butyl ether, and mixtures thereof.

Suitable glycol ether solvents according to Formula II include propyleneglycol n-propyl ether, dipropyleneglycol n-propyl ether, tripropyleneglycol n-propyl ether, propyleneglycol isopropyl ether, dipropyleneglycol isopropyl ether, tripropyleneglycol isopropyl ether, propyleneglycol n-propyl methyl ether, dipropyleneglycol n-propyl methyl ether, tripropyleneglycol n-propyl methyl ether, propyleneglycol isopropyl methyl ether, dipropyleneglycol isopropyl methyl ether, tripropyleneglycol isopropyl methyl ether, and mixtures thereof.

Preferred glycol ether solvents according to Formula II are propyleneglycol n-propyl ether, dipropyleneglycol n-propyl ether, and mixtures thereof.

Most preferred glycol ether solvents are propyleneglycol n-butyl ether, dipropyleneglycol n-butyl ether, and mixtures thereof, especially dipropyleneglycol n-butyl ether.

Suitable glycol ether solvents can be purchased from The Dow Chemical Company, more particularly from the E-series (ethylene glycol based) Glycol Ethers and the P-series (propylene glycol based) Glycol Ethers line-ups. Suitable glycol ether solvents include Butyl Carbitol, Hexyl Carbitol, Butyl Cellosolve, Hexyl Cellosolve, Butoxytriglycol, Dowanol Eph, Dowanol PnP, Dowanol DPnP, Dowanol PnB, Dowanol DPnB, Dowanol TPnB, Dowanol PPh, and mixtures thereof.

The glycol ether of the product of the invention can boost foaming

The glycol ether solvent typically is present from about 1% to about 10%, preferably from about 2 to about 8%, most preferably from about 3% to about 7% by weight of the composition Chelant The composition herein may optionally further comprise a chelant at a level of from 0.1% to 10%, preferably from 0.2% to 5%, more preferably from 0.2% to 3%, most preferably from 0.5% to 1.5% by weight of the composition.

Suitable chelating agents can be selected from the group consisting of amino carboxylates, amino phosphonates, polyfunctionally-substituted aromatic chelating agents and mixtures thereof.

Amino carboxylates include ethylenediaminetetra-acetates, N-hydroxyethylethylenediaminetriacetates, nitrilotriacetates, ethylenediamine tetraproprionates, triethylenetetraaminehexacetates, diethylenetriaminepentaacetates, and ethanoldiglycines, alkali metal, ammonium, and substituted ammonium salts therein and mixtures therein, as well as MGDA (methyl-glycine-diacetic acid), and salts and derivatives thereof and GLDA (glutamic-N,N-diacetic acid) and salts and derivatives thereof. GLDA (salts and derivatives thereof) is especially preferred according to the invention, with the tetrasodium salt thereof being especially preferred.

Builder

The composition herein may comprise a builder, preferably a carboxylate builder. Salts of carboxylic acids useful herein include salts of C1-6 linear or at least 3 carbon containing cyclic acids. The linear or cyclic carbon-containing chain of the carboxylic acid or salt thereof may be substituted with a substituent group selected from the group consisting of hydroxyl, ester, ether, aliphatic groups having from 1 to 6, more preferably 1 to 4 carbon atoms, and mixtures thereof.

Preferred salts of carboxylic acids are those selected from the salts from the group consisting of salicylic acid, maleic acid, acetyl salicylic acid, 3 methyl salicylic acid, 4 hydroxy isophthalic acid, dihydroxyfumaric acid, 1,2, 4 benzene tricarboxylic acid, pentanoic acid, citric acid, and mixtures thereof, preferably citric acid.

Alternative carboxylate builders suitable for use in the composition of the invention includes salts of fatty acids like palm kernel derived fatty acids or coconut derived fatty acid, or salts of polycarboxylic acids.

The cation of the salt is preferably selected from alkali metal, alkaline earth metal, monoethanolamine, diethanolamine or triethanolamine and mixtures thereof, preferably sodium.

The carboxylic acid or salt thereof, when present, is preferably present at the level of from 0.1% to 5%, more preferably from 0.2% to 1% by weight of the total composition.

Shear Thinning Rheology Modifier

The composition according to the invention might further comprise a rheology modifying agent, providing a shear thinning rheology profile to the product. Preferably the rheology modifying agent is a non crystalline polymeric rheology modifier. This polymeric rheology modifier can be a synthetic or a naturally derived polymer.

Examples of naturally derived polymeric structurants of use in the present invention include: hydroxyethyl cellulose, hydrophobically modified hydroxyethyl cellulose, carboxymethyl cellulose, polysaccharide derivatives and mixtures thereof. Polysaccharide derivatives include but are not limited to pectine, alginate, arabinogalactan (gum Arabic), carrageenan, gum karaya, gum tragacanth, gellan gum, xanthan gum and guar gum. Examples of synthetic polymeric structurants of use in the present invention include polymers and copolymers comprising polycarboxylates, polyacrylates, polyurethanes, polyvinylpyrrolidone, polyols and derivatives and mixtures thereof.

Preferably the composition according to the invention comprises a naturally derived rheology modifying polymer, most preferably Xanthan Gum.

Generally, the rheology modifying polymer will be comprised at a level of from 0.001% to 1% by weight, alternatively from 0.01% to 0.5% by weight, more alternatively from 0.05% to 0.25% by weight of the composition.

Further Optional Ingredients

The composition herein may comprise a number of optional ingredients such as rheology trimming agents selected from inorganic salts preferably sodium chloride, C2-C4 alcohols, C2-C4 polyols, poly alkylene glycols, hydrotropes, and mixtures thereof. The composition might also comprise pH trimming and/or buffering agents such as sodium hydroxyde, alkanolamines including monoethanolamine, and bicarbonate inorganic salts. The composition might comprise further minor ingredients selected from preservatives, UV stabilizers, antioxidants, perfumes, coloring agents and mixtures thereof.

Viscosity

The flow curve of products is measured with the use of a Rheometer (TA instruments—model DHR1), a Peltier concentric cylinder temperature system (TA instruments) and a double gap cup and rotor (TA instruments). The flow curve procedure comprises a conditioning step and a flow ramp step at 20° C., the conditioning step comprising a 30 s pre-shear step at a shear rate of 10 s-1 followed by a 120 s zero shear equilibration time. The flow ramp step comprises a Logarithmical shear rate increase from 0.001 s-1 to 10000 s-1 in a time span of 300 s. A data filter is set at the instrument recommended minimum torque value of 20 μNm.

"Low shear viscosity" is defined as the viscosity measured at a shear rate of 100 s-1. "High shear viscosity" is measured at a shear rate of 10000 s-1.

Spray Dispenser

The spray dispenser comprises a housing to accommodate the composition of the invention and spraying means. Suitable spray dispensers include hand pump (sometimes referred to as "trigger") devices, pressurized can devices, electrostatic spray devices, etc. Preferably the spray dispenser is non-pressurized and the spray means are of the trigger dispensing type. Preferably the spray dispenser is non-pressurized and the spray means are of the trigger dispensing type.

EXAMPLES

Cleaning provided by compositions inside and outside the scope of the invention is assessed by means of a whiteness index defined following the procedure described below.

Cooked Oil Soil Preparation

Soil preparation prior to baking is carried out at ambient temperature of 21° C.+−2° C. All used products should be acclimatized within this temperature range.

Corn oil (Supplier: Vandemoortele—Item: #1001928), peanut oil (Supplier: Vandemoortele—Item: #1002974) and sunflower oil (Supplier: Vandemoortele—Item: #1001926) are mixed in equal weight amounts. Whilst mixing, 1 wt. % black dye (Supplier: AMRESCO—Item: Sudan Black B #0593) is added on top. Mixing is continued afterwards for 1 hour.

20 g of the above mixture is then put in a Borosilicate Glass baking dish (Supplier: Pyrex—Item: sku232B000) and baked in an oven at 135° C. for 16 hours. After baking, the Pyrex plate is put overnight in a humidity cabinet at 25° C. and 70% humidity level. The polymerized oil is then collected in a glass vial.

Tile Preparation and Camera Setup

With the help of a paint roller, cooked oil is applied to a ceramic white tile (Supplier: Sphinx—Item: White tile 20 cm×25 cm #H083001) until a uniform layer is obtained (1.25 g+/−0.1 g of oil required). The tile is placed on a flat surface. With the help of a stand, a photo-camera is placed at approximately 63 cm above the tile.

Test Execution

The test is carried out at ambient temperature of 21° C.+−2° C. All used products should be acclimatized within this temperature range.

The test is conducted pairwise on one tile, with a standard benchmark during every run. With the help of a Pasteur pipette (Supplier: VWR—Item: 5 ml #612-1684) one drop of product is pipetted to the tile from a height of approx. 10 cm. This is done, in parallel/synchronized, with the benchmark product, each in the middle of one half of the tile. A timer is started, right after products are pipetted to the tile. A picture is taken after 30 seconds product exposure.

Product Assessment

Afterwards, with the help of the picture, the test product is compared to the reference and a grading number on the cleanness of the diffusion area (whiteness index):

−4: Negative WOW/−3: Definitely worse/−2: I see it's worse/−1: I Think it's worse 0: reference +1: I Think it's better/+2: I see it's better/+3: Definitely better/+4: Positive WOW Composition

| % active by weight of the composition | Example 1 | Comparative example 1 | Comparative example 2 | Comparative example 3 | Comparative example 4 | Comparative example 5 Dreft Power Spray Belgium | Comparative example 6 Method HDW Spray Market Product Bottle code: 14205A |
|---|---|---|---|---|---|---|---|
| Water and minors (preservative, perfume, dye) | To 100 parts | To 100 parts | To 100 parts | n.a. | To 100 parts | To 100 parts | |
| Sodium Chloride | — | — | — | — | 0.11 | — | |
| Sodium bicarbonate | 0.1 | 0.5 | 0.1 | — | — | — | |
| Ethanol | 0.34 | 0.34 | 0.34 | — | 0.215 | — | |
| Polypropylene glycol | 0.05 | 0.05 | 0.05 | — | 0.12 | — | |
| Sodium Cumene Sulphonate | — | — | — | — | — | 4.56 | |
| EPh Glycol ether | — | — | — | — | — | 5 | |
| DPnB Glycol Ether | 5 | 5 | — | 100 | — | 5 | |
| Mono-ethanolamine | 0.5 | — | 0.5 | — | — | 5 | |
| L-glutamic acid N,N-diacetic acid, tetra sodium salt | 1 | 0.25 | 1 | — | — | — | |
| Citric Acid | — | 0.25 | — | — | — | — | |
| TPK Fatty Acid | — | 0.84 | — | — | — | — | |
| Acusol 823 | — | — | — | — | — | 1.5 | |
| Laponite RDS | — | — | — | — | — | 0.31 | |
| Laponite RD | — | — | — | — | — | 0.31 | |
| Sodium Silicate | — | — | — | — | — | 0.30 | |
| Potassium carbonate | — | — | — | — | — | 1 | |
| Sodium Hydroxide | — | 0.62 | — | — | 0.02 | 0.64 | |
| Alkyl Ethoxy Sulphate (C24EO3) | 6.55 | — | 6.55 | — | — | — | |

-continued

| % active by weight of the composition | Example 1 | Comparative example 1 | Comparative example 2 | Comparative example 3 | Comparative example 4 | Comparative example 5 Dreft Power Spray Belgium | Comparative example 6 Method HDW Spray Market Product Bottle code: 14205A |
|---|---|---|---|---|---|---|---|
| Alkyl Ethoxy Sulphate (C24EO0.6) | — | — | — | — | 0.2253 | — | |
| Lin. Alkyl Benzene Sulfonate | — | 1.5 | — | — | — | — | |
| Alkyl Dimethyl Amine Oxide (C12-14) | 2.45 | 1.3 | 2.45 | — | 0.644 | 1 | |
| C10 (Guerbet) alcohol 8 Ethoxylated | — | — | — | — | 0.044 | — | |
| Non-ionic Alkyl Ethoxylate (C9-11EO8) | — | 5.2 | — | — | — | — | |
| Xanthan Gum | 0.10 | — | 0.10 | — | — | — | |
| pH (10% dilution in distilled water) | 10.9 | 10.1 | 10.9 | n.a. | 9.1 | 11.4 | |

Results

Example 1 represents a formula according to the invention. Comparative examples 2 to 6 represent formula compositions outside the scope of the invention. Comparative example 1 has a surfactant system outside the scope of the invention. Comparative examples 3 and 4 are single variable deviations of example formula 1 from which respectively the solvent according to the invention has been removed (comparative example 2) or tested in isolation (comparative example 3). Comparative example 4 represents a low active version of a traditional surfactant based hand dish formulation liquid, while comparative example 5 represents a detergent spray composition used as a pre-treater for automatic dishwashing applications. Comparative example 6 is an in market hand dishwashing spray product from the "Method" company. From the data in the table below it is clear that a formula composition according to the invention has the highest cleanness of the diffusion area after 30 seconds product exposure time, compared to the comparative examples outside of the scope of the invention.

| Reference product | Test product | Whiteness Index (the higher the better) |
|---|---|---|
| Comparative example 1 | Example 1 | +3 |
| Comparative example 1 | Comparative example 2 | +1 |
| Comparative example 1 | Comparative example 3 | No cleaning observed* |
| Comparative example 1 | Comparative example 4 | +1 |

-continued

| Reference product | Test product | Whiteness Index (the higher the better) |
|---|---|---|
| Comparative example 1 | Comparative example 5 | −2 |
| Comparative example 1 | Comparative example 6 | 0 |

*Solvent shifts soil outside product application area with no soil emusification or solubilization happening. No grading applied as different and inferior (i.e. no cleaning) effect observed.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A cleaning product comprising a spray dispenser and a cleaning composition suitable for spraying and foaming, the composition housed in the spray dispenser wherein the composition comprises:

i) about 5% to about 14% by weight of a surfactant system comprising a C12-C14 alkyl ethoxylated sulfate anionic surfactant and a co-surfactant, wherein the co-surfactant is an amphoteric surfactant comprising amine oxide surfactants; and ii) about 1% to about 7% by weight of the composition of a glycol ether solvent selected from the group consisting of glycol ethers of Formula I: R1O(R2O)nR3, Formula II: R4O(R5O)nR6 and mixtures thereof wherein R1 is a linear or branched C4, C5 or C6 alkyl, a substituted or unsubstituted phenyl, R2 is ethyl or isopropyl, R3 is hydrogen or methyl and n is 1, 2 or 3

R4 is n-propyl or isopropyl, R5 is isopropyl, R6 is hydrogen or methyl and n is 1, 2 or 3;

wherein the surfactant system and the solvent are in a weight ratio of from 4:1 to 1:1, wherein the composition has a high shear viscosity (at 10,000 s-1) of from about 1 to about 20 mPa s at 20° C. as measured using the viscosity test method defined herein, and wherein the composition foams when it is sprayed.

2. A product according to claim 1 wherein the alkyl ethoxylate sulfate has an average degree of ethoxylation of from about 2 to about 5.

3. A product according to claim 1 wherein the glycol ether solvent is selected from the group consisting of comprises dipropylene glycol n-butyl ether, propyleneglycol n-butyl ether and mixtures thereof.

4. A product according to claim 1 wherein the composition has a pH from about 10.5 to about 11.5 as measured at 10% solution in distilled water at 20° C. and a reserve alkalinity of from about 0.1 to about 1 expressed as g NAOH/100 ml of composition at a pH of 10.

5. A product according to claim 1 wherein the composition has a reserve alkalinity of from about 0.1 to about 0.5 expressed as g NAOH/100 ml of composition at a pH of 10.

6. A product according to claim 1 wherein the composition has a pH of from about 10 to about 11.5 as measured in a 10% solution in distilled water at 20° C., a reserve alkalinity of from about 0.1 to about 0.3, expressed as g NAOH/100 ml of composition at a pH of 10, the composition comprising:

i) about 4 to about 10% by weight of the composition of a C12-C14 alkyl ethoxylated sulfate, the alkyl ethoxylated sulfate having an average degree of ethoxylation of about 3;

ii) about 1 to about 5% by weight of the composition of amine oxide surfactant; and iii) about 3% to about 7% by weight of the composition of glycol ether solvent.

7. A product according to claim 1 wherein the composition further comprises a chelant.

8. A product according to claim 1 wherein the composition further comprises a builder.

9. A product according to claim 1 wherein the composition further comprises bicarbonate.

10. A product according to claim 1 wherein the composition further comprises an alkanol amine.

11. A product according to claim 1 wherein the composition further comprises a further solvent selected from the group consisting of C2-C4 alcohols, C2-C4 polyols, poly alkylene glycol and mixtures thereof.

12. A product according to claim 1 wherein the composition has a low shear (100 s-1) to high shear viscosity ratio of from about 10:1 to about 1.5:1 at 20° C. as measured using the viscosity test method defined herein.

13. A product according to claim 1 wherein the composition comprises a rheology modifier.

14. A method of cleaning soiled dishware using the product according to claim 1 comprising the steps of:

a) optionally pre-wetting the soiled dishware;

b) spraying the cleaning composition onto the soiled dishware;

c) optionally adding water to the soiled dishware during a period of time;

d) optionally scrubbing the dishware; and e) rinsing the dishware.

* * * * *